US007114341B2

(12) United States Patent
Gao

(10) Patent No.: US 7,114,341 B2
(45) Date of Patent: Oct. 3, 2006

(54) CRYOPUMP WITH TWO-STAGE PULSE TUBE REFRIGERATOR

(75) Inventor: Jin Lin Gao, Allentown, PA (US)

(73) Assignees: SHI-APD Cryogenics, Inc., Allentown, PA (US); Sumitomo Heavy Industries, Ltd., Tokyo (JP)

( * ) Notice: Subject to any disclaimer, the term of this patent is extended or adjusted under 35 U.S.C. 154(b) by 82 days.

(21) Appl. No.: 10/934,909

(22) Filed: Sep. 2, 2004

(65) Prior Publication Data

US 2006/0026968 A1 Feb. 9, 2006

Related U.S. Application Data

(63) Continuation of application No. PCT/US03/00386, filed on Jan. 8, 2003.

(60) Provisional application No. 60/346,512, filed on Jan. 8, 2002.

(51) Int. Cl.
*F25B 9/00* (2006.01)
*B01D 8/00* (2006.01)

(52) U.S. Cl. ..... 62/6; 62/55.5

(58) Field of Classification Search ..... 62/6, 62/55.5

See application file for complete search history.

(56) References Cited

U.S. PATENT DOCUMENTS

| | | | | |
|---|---|---|---|---|
| 5,443,548 | A | 8/1995 | Saho et al. | |
| 5,845,498 | A | 12/1998 | Matsui et al. | |
| 5,974,807 | A * | 11/1999 | Gao et al. | 62/6 |
| 6,263,677 | B1 | 7/2001 | Hafner et al. | |
| 6,293,109 | B1 | 9/2001 | Miyamoto | |
| 6,467,277 | B1 * | 10/2002 | Okamura et al. | 62/6 |
| 6,813,891 | B1 * | 11/2004 | Heron et al. | 62/6 |

FOREIGN PATENT DOCUMENTS

| | | |
|---|---|---|
| JP | 10-184540 | 7/1998 |

* cited by examiner

*Primary Examiner*—William C. Doerrler
(74) *Attorney, Agent, or Firm*—Katten Muchin Rosenman LLP

(57) ABSTRACT

Disclosed is a two-stage pulse tube cryopump cooling system in which the pulse tubes and valves are inline, with the hot ends of the pulse tubes at the top and the valve mechanism is at the bottom and the hot ends and buffer volume are cooled by an inline coolant line from the compressor input to the compressor output and attached in heat exchange relationship with the buffer volume.

7 Claims, 4 Drawing Sheets

CRYOPUMP WITH TWO-STAGE PULSE TUBE REFRIGERATOR

This application is a continuation of International Application No. PCT/US03/00386, filed Jan. 8, 2003, which claims the benefit under 35 U.S.C. 119(e) of U.S. Provisional Application No. 60/346,512, filed Jan. 8, 2002 which is herein incorporated by reference.

BACKGROUND OF THE INVENTION

The pulse tube refrigerator is a cryocooler, similar to Stirling and Gifford-McMahon refrigerators, which derive cooling from the compression and expansion of gas. However, unlike the Stirling and Gifford-McMahon (G-M) systems, in which the gas expansion work is transferred out of the expansion space by a solid expansion piston or displacer, pulse tube refrigerators have no moving parts in their cold end, but rather an oscillating gas column within the pulse tube (called a gas piston) that functions as a compressible displacer. The elimination of moving parts in the cold end of pulse tube refrigerators allows a significant reduction of vibration, as well as greater reliability and lifetime, and is thus potentially very useful in many applications, both military and commercial.

Most military type applications use Stirling pulse tubes that operate at frequencies of 20 to 60 Hz, and as a result of the high speed are small, but are limited to temperatures above about 20 K. Cryogenic temperatures as cold as 3 K are achievable using two stage GM type pulse tube refrigerators which typically operate at 1 to 2 Hz. Cryocoolers operating at either 10 K or 4 K are presently used to cool the superconducting magnets used in magnetic resonance imaging (MRI) systems. A minimum temperature of about 12 K is highly desirable in such commercial applications as cryopumps, which are often used to purge gases from semiconductor fabrication vacuum chambers.

In each of these applications, there exist continued efforts to further reduce the level of vibration produced by the cryogenic refrigerator. Pulse tube refrigeration systems that are characterized by lower vibration will greatly increase the reliability and lifetime of cryocoolers.

Most vacuum chamber processes are very sensitive to vibration. With processes requiring accuracy to within nanometers, any motion can result in production defects. Conventional vacuum chamber pumps involve a system of moving parts that can cause the movement of production elements. What is needed is a way to reduce the vibration generated by a cryopump.

Cryopumps must be cooled to temperatures as low as 12 K to condense and solidify or adsorb various species of chamber gases onto one or more cryopanels. Conventional refrigerators used for obtaining these low temperatures are Gifford McMahon, GM, cycle systems, however, these systems have significantly more vibration than a pulse tube. What is needed is a way to cool a cryopump using a two-stage pulse tube.

Two-stage pulse tube refrigerators need to have the hot ends of the pulse tubes at the top in order to avoid convective losses within the pulse tubes. It is also most common to have a bulky valve mechanism on top of the cooler so the necessary valves can be integrated into a common housing and the heat that is generated at the hot ends of the pulse tubes can be transferred to the low pressure gas returning to the compressor within this same housing. In most cryopump applications it is preferred to mount the cryopump below the vacuum chamber, with a minimum space between the cryopump housing and the vacuum chamber.

A conventional two-stage pulse tube refrigerator with double orifice phase control requires a buffer volume that is relatively large. It is possible to have a significantly smaller buffer volume that can be integrated with the hot ends of the pulse tubes by using inter-phase control in combination with double orifice phase control. The buffer volume compensates for the difference in the volumes between the two stages of the pulse tubes.

Gao et al., U.S. Pat. No. 5,974,807, dated Nov. 2, 1999 and entitled "Pulse Tube Refrigerator" describes a pulse tube refrigerator capable of generating cryogenic temperatures of below 10 K that includes first and second refrigeration stages. Each stage includes a pulse tube and an associated regenerator provided at the low temperature side of the pulse tube. A pressure fluctuation generator having a compressor and a first to a fourth valve is provided at the high temperature side of each regenerator. The high temperature ends of each pulse tube are connected by a continuous channel, while the high temperature ends of each pulse tube and the high temperature ends of each regenerator are connected by a by-pass channel. A magnetic material having a rare-earth element and a transition metal is used as a regenerative material for the regenerator.

When pressure fluctuation is generated in each pulse tube at the phase difference angle of 180 degrees, respectively, a working gas is transferred between the high temperature ends of each pulse tube as controlled by an active valve, and between the high temperature ends of each pulse tube and its associated regenerator as controlled by a passive valve. This optimizes the phase angle between the pressure fluctuation in each pulse tube and the displacement of the working gas.

Li, U.S. Pat. No. 5,927,081, dated Jul. 27, 1999 and entitled "Pulse Tube Refrigerator and its Running Method" describes a method of running a pulse tube refrigerator that has a regenerator and a pulse tube each defining a high temperature end and a low temperature end, the low temperature ends of the regenerator and the pulse tube communicating with each other, and the high temperature end of the regenerator being connected to a gas compressor. A cold area is formed at the low temperature ends by periodically supplying working gas from the high temperature end of the regenerator to the regenerator and recovering the working gas from the regenerator. The temperature of the low temperature ends is raised by steadily, pulsatively, or intermittently flowing gas in one direction through a communicating area between the low temperature ends of the regenerator and the pulse tube.

Matsui et al., U.S. Pat. No. 5,845,498, Dated Dec. 8, 1998 and entitled "Pulse Tube Refrigerator" describes a pulse tube refrigerator where the cryostat includes regenerators and pulse tubes. Each regenerator has a cold stage at an upper end thereof. Each pulse tube has a low-temperature end portion at a lower end thereof and a high-temperature end portion thereof, the low-temperature end portion being located lower than the cold stage. The cold stage and the low-temperature end portion are connected to each other through a line whose cubic volume is substantially negligible in comparison with that of the pulse tube. Since the pulse tube has working gas of relatively high (should be low) density in an upper portion thereof and working gas of relatively low (should be high) density in a lower portion thereof, there is no convection of working gas induced by the gravity.

Chan, C. K. and Tward, E., U.S. Pat. No. 5,107,683, dated Apr. 28, 1992 and entitled "Multistage Pulse Tube Cooler"

describes a multistage pulse tube cooler in which a portion of the heat from each successively lower-temperature pulse tube cooler is rejected to a heat sink other than the preceding higher-temperature pulse tube cooler, thus substantially improving the overall efficiency of the multistage cooler. Multistage pulse tube coolers of the prior art reject all the heat from each successively lower-temperature pulse tube cooler to the preceding higher-temperature pulse tube cooler, thus imposing a large cooling load on the higher-temperature pulse tube coolers which considerably reduces the overall efficiency of the cooler.

Zhu, S. and Wu, P., "Double inlet pulse tube refrigerators: an important improvement", Cryogenics, vol. 30 (1990), p. 514 describe the second orifice and how it improves the performance of a single stage pulse tube. A. Watanabe, G. W. Swift, and J. G. Brisson, Superfluid orifice pulse tube below 1 Kelvin, Advances in Cryogenic Engineering, Vol. 41B, pp. 1519–1526 (1996) describe inter-phase control. It discusses a very low temperature Stirling cycle cooler that has one passive orifice between two identical pulse tubes. J. L. Gao and Y. Matsubara, An inter-phasing pulse tube refrigerator for high refrigeration efficiency, in: "Proceedings of the 16th International Cryogenic Engineering Conference", T. Haruyama, T. Mitsui and K. Yamafriji, ed., Eisevier Science, Oxford (1997), pp. 295–298 discuss identical dual 1, 2, and 3 stage pulse tubes with single active interconnect valves. C. K. Chan, C. B. Jaco, J. Raab, E. Tward, and M. Waterman, Miniature pulse tube cooler, Proc. 7th Int'l Cryocooler Conf., Air Force Report PL-CP-93-1001 (1993) pp. 113–124 describe a Stirling single stage pulse tube that is inline, thus the hot end of the pulse tube is remote from the regenerator inlet. It has double orifice control. Heat from the hot end of the pulse tube and buffer are rejected to the base at the regenerator inlet by conduction through the buffer housing which extends the full length of the pulse tube. The hot end of the pulse tube is not attached to the vacuum housing so the entire pulse tube assembly can be easily removed.

There continues to exist the need for a pulse tube cooled cryopump, where the refrigeration unit has an inline configuration with the hot ends of the pulse tubes on top and where there is easy access to the components of the refrigeration unit. It would be desirable to configure a two-stage pulse tube refrigerator so that the valve mechanism is below the cryopump housing, the regenerators and pulse tubes are inline with the hot ends of the pulse tubes on top, and there is a means to remove the heat that is generated at the hot ends of the pulse tubes. It is also desirable to have access to the components of the two-stage pulse tube refrigerators to permit the cryopanels and the pulse tubes to be removed.

It is an object of the present invention to provide a way to cool cryopanels in a cryopump using a two-stage pulse tube.

It is an object of the present invention to provide a design for an inline two-stage pulse tube refrigerator.

It is an object of the present invention to provide a way to remotely remove heat from the hot end of an inline two-stage pulse tube refrigerator.

It is an object of the present invention to provide a means to minimize the size of an inline two-stage pulse tube refrigerator.

It is an object of the present invention to allow easy servicing of the system by removably attaching the cryopanels to the pulse tube and the pulse tube itself from the cryopump housing.

It is an object of the present invention to reduce the vibration generated by a cryopump.

It is an object of the present invention to provide a long maintenance cycle before regular maintenance is required.

It is an object of the present invention to offer improved reliability relative to existing GM refrigerators.

SUMMARY

The invention comprises a two-stage pulse tube cryopump cooling system in which the pulse tubes and regenerators are inline, with the hot ends of the pulse tubes at the top and the valve mechanism at the bottom. Heat that is generated at the hot ends of the pulse tubes is removed by the use of gas flowing back to the compressor through an inline coolant line to cool the hot ends of the pulse tubes and the buffer volume.

In the present invention the two stage pulse tube refrigerator is removable from the cryopump housing. An inline two-stage pulse tube refrigerator cools the cryopanels, the hot end is up, and the hot end and buffer are in the vacuum space. The size of the buffer volume is minimized and heat is removed from the hot ends of the pulse tubes and buffer volume in a novel way. The cryopump comprises a two-stage pulse tube refrigerator with removable cryopanels.

DETAILED DESCRIPTION OF THE INVENTION

The present invention is a compact, inline two-stage pulse tube refrigerator, in which the pulse tube is oriented with the valve mechanism on the bottom, integrated with multiple embodiments of a cryopump, including a side inlet cryopump and top inlet cryopump.

Figure 1:
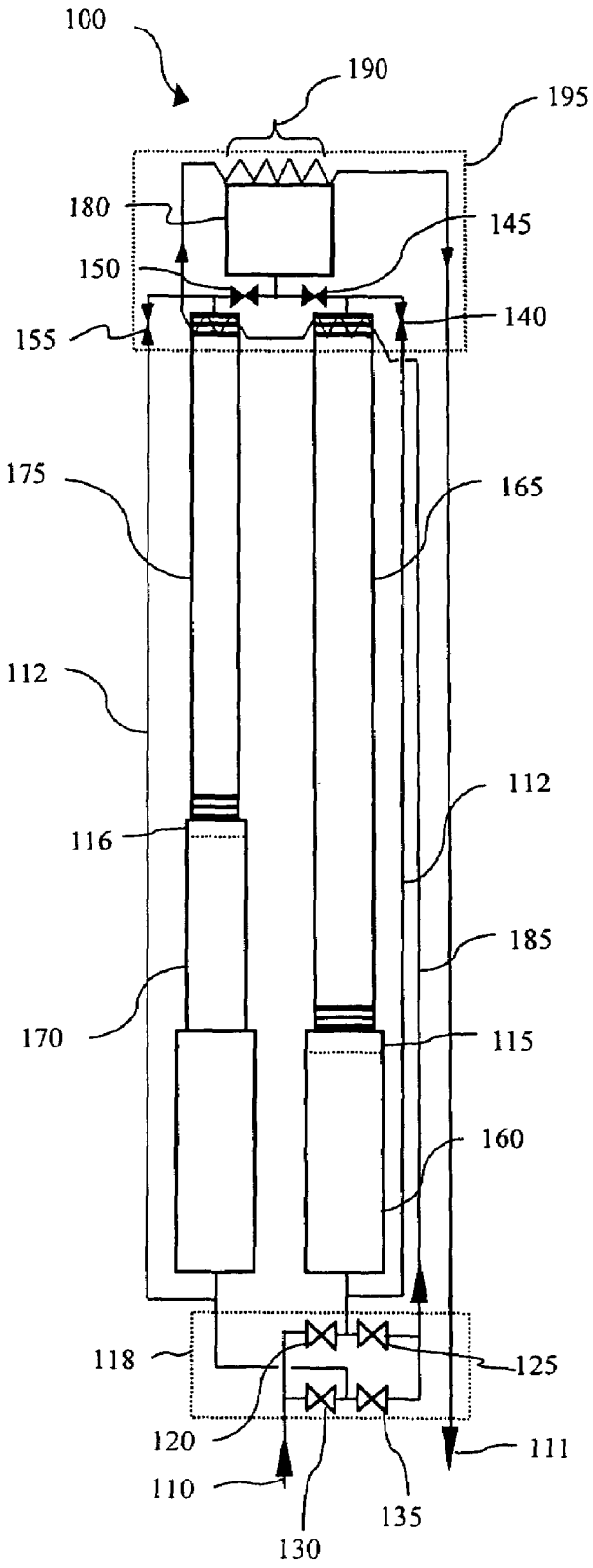
FIG. 1 shows a schematic for an inline pulse tube refrigerator.

FIG. 1 shows a schematic for an inline pulse tube refrigerator 100, including an inlet 110, an outlet 111, a bypass channel 112, a valve 120, a valve 125, a valve 130, a valve 135, flow restrictors 140, 145, 150, and 155, a first stage regenerator 160, and pulse tube 165, a second stage regenerator 170, and pulse tube 175, a buffer tank 180, a cooling line 185, and cooling fins 190. The four valves 120, 125, 130, and 135 are active valves that may be incorporated in a single rotary disc as part of valve assembly 118. Typical rotational speed would be 2 Hz resulting in 120 pulses per minute.

Inlet 110 and outlet 111 are gas supply and return lines from a compressor for providing a working gas (Helium) within inline pulse tube refrigerator 100. Optimum system parameters find inlet 110 supplying a high pressure of 280 psig and outlet 111 having a return pressure of 100 psig.

An essential feature of the present design is the use of gas flowing back to the compressor through cooling line 185 to cool the hot ends of the pulse tubes and the buffer tank 180, shown generally as fins 190.

FIG. 1 shows the four fixed orifices, 140, 145, 150, and 155 in bypass line 112. In actual practice the hot end heat exchangers in the pulse tubes, and the four fixed orifices may be incorporated in a single housing with the buffer tank 180 and cooling fins 190 connected to cooling line 185, shown as hot end 195.

Regenerator 160 is the first stage regenerative heat exchanger, whose size and dimension are largely dependent upon the application and demands for which cryocooler 200 is designed. Regenerator 160 may be cylindrical in overall shape and include one or more axial passage(s) containing a matrix—an open, thermally conductive structure with many flow paths and large surface area for transfer of heat to and from the working gas. Bronze or stainless steel screens are typically used for temperatures above 50 K because they have high thermal specific heat and low thermal conductivity.

Pulse tube 165 is the first stage pulse tube, whose size and dimensions are largely dependent upon the application and demands for which cryocooler 200 is designed. Pulse tube 165 is a thin-walled stainless steel tube brazed with mesh copper screen disks at each end, which serve to both exchange heat and smooth the flow of gas into a laminar profile.

Regenerator 170 is the second stage regenerative heat exchanger, whose size and dimension are largely dependent upon the application and demands for which cryocooler 200 is designed. Regenerator 170 may be cylindrical in overall shape and include one or more axial passage(s) containing a matrix—an open, thermally conductive structure with many flow paths and large surface area for transfer of heat to and from the working gas. Regenerator 170 may be made of any material of high thermal specific heat. In one example, regenerator 170 is filled with a combination of bronze screen disks at the warm end and lead shot at the cold end. Lead is a good regenerator material between 50 K and 10 K. 12 K is typically the minimum operating temperature that is desirable for a cryopump, so the rare earth regenerator materials that can enable a pulse tube refrigerator to get to 4 K would not be used.

Pulse tube 175 is the second stage pulse tube, whose size and dimensions are largely dependent upon the application and demands for which cryocooler 200 is designed. Pulse tube 175 is a thin-walled stainless steel tube brazed with mesh copper screen disks at each end, which serve to both exchange heat and smooth the flow of gas into a laminar profile.

In operation, oscillating pressure is supplied by valve assembly 118 and generates an oscillating gas flow in the regenerators and pulse tubes. Although helium is the working gas in the present invention, the working gas may be selected arbitrarily depending on desired cryogenic temperature, desired output, or the like. For example, the working gas may be argon, hydrogen, or a mixture thereof with helium included. This gas flow carries heat away from the low temperature points (the bottom of pulse tube 165 and the bottom of pulse tube 175). Pressure is generated in the pulse tubes of each stage 180 degrees out of phase by the cycling of a gas from inlet 110 to outlet 111. Since the high temperature (top) ends of pulse tube 165 and pulse tube 175 are connected to one another via buffer tank 180, once refrigeration is generated in the first stage, a portion of the working gas moves from the high temperature side of pulse tube 175 of the second stage to the high temperature side of pulse tube 165 of the first stage, and the phase angle between the pressure fluctuation in pulse tube 175 and the displacement of its working gas (gas piston) is optimized. Low temperature points at the bottom of pulse tube 165 and the bottom of pulse tube 175 then provide cooling at cold stations 115 and 116 respectively.

The refrigeration cycle pumps heat from the cold stations to the hot ends of the pulse tubes and the buffer tank. In the present invention this heat is removed by circulating low-pressure gas after leaving valves 125 and 135 though cooling line 185 and the cooling fins 190 that are attached to the hot ends of the pulse tubes and the buffer tank.

The objective of minimizing the size of a two-stage inline pulse tube is accomplished by using interphase control, in which the two stages operate 180 degrees out of phase and transfer gas through bypass channels 112 with restrictors 145 and 150 between the hot ends of the pulse tubes and buffer tank 180. The volume of 180 would be zero if an equal amount of gas flowed from both pulse tubes, but in practice the flow is not equal and buffer tank 180 accommodates the difference. Conventional single or double orifice control in which the pulse tubes are pressure cycled together requires a much larger buffer tank, which would be impractical in a cryopump.

Figure 2A:
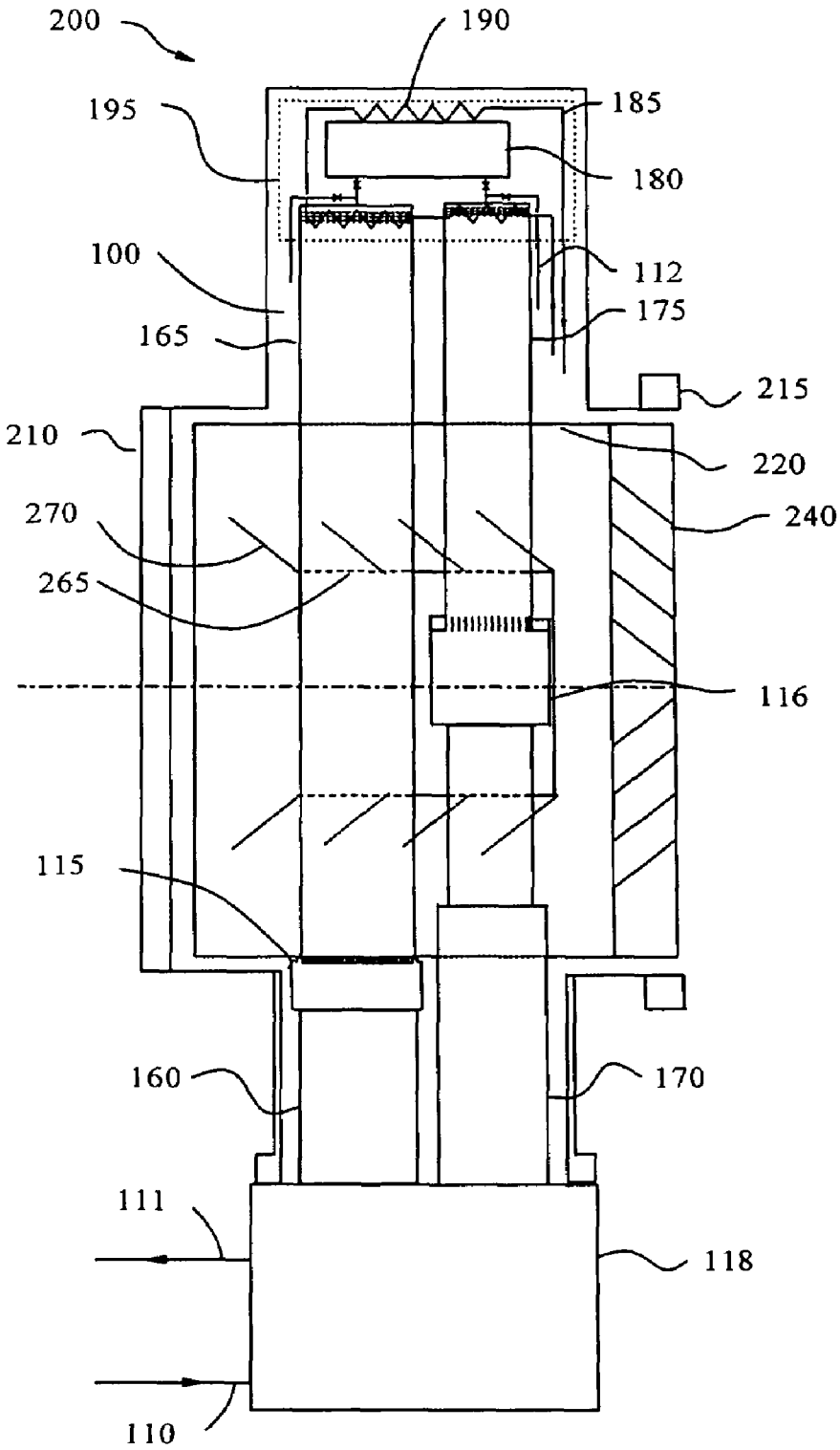
FIGS. 2*a*, 2*b*, and 2*c* illustrate a side-view, front view, and an end view, respectively, of a cryopump with the inline pulse tube refrigerator of FIG. 1.
Figure 2B:
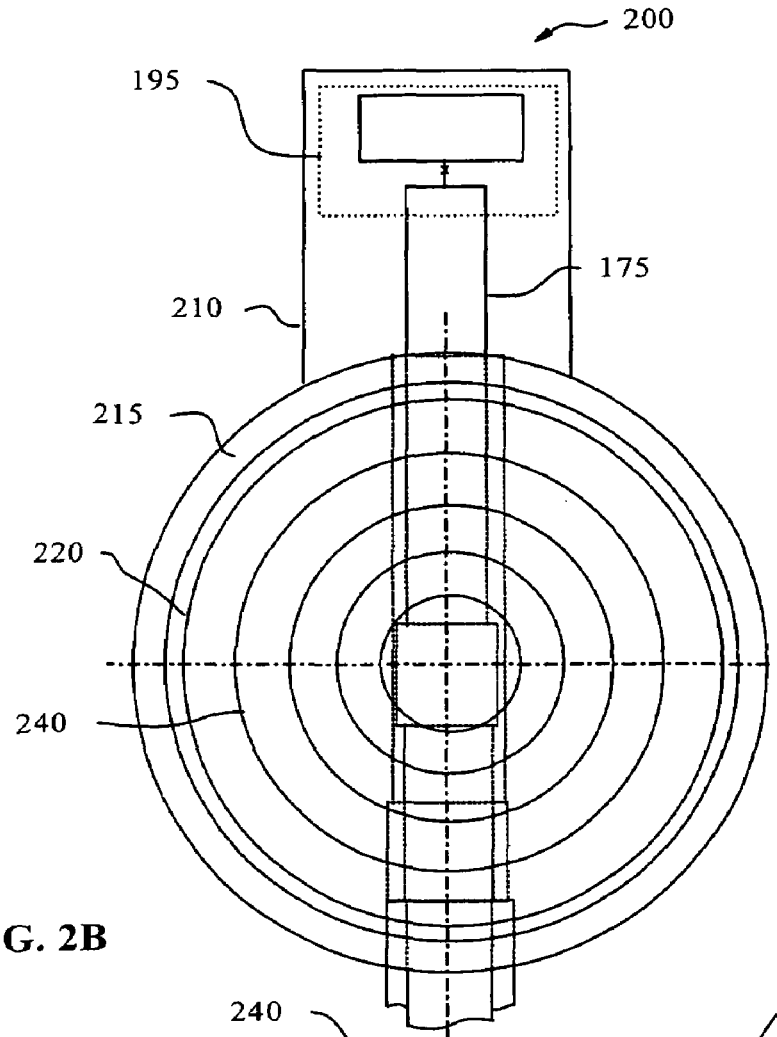
Figure 2C:
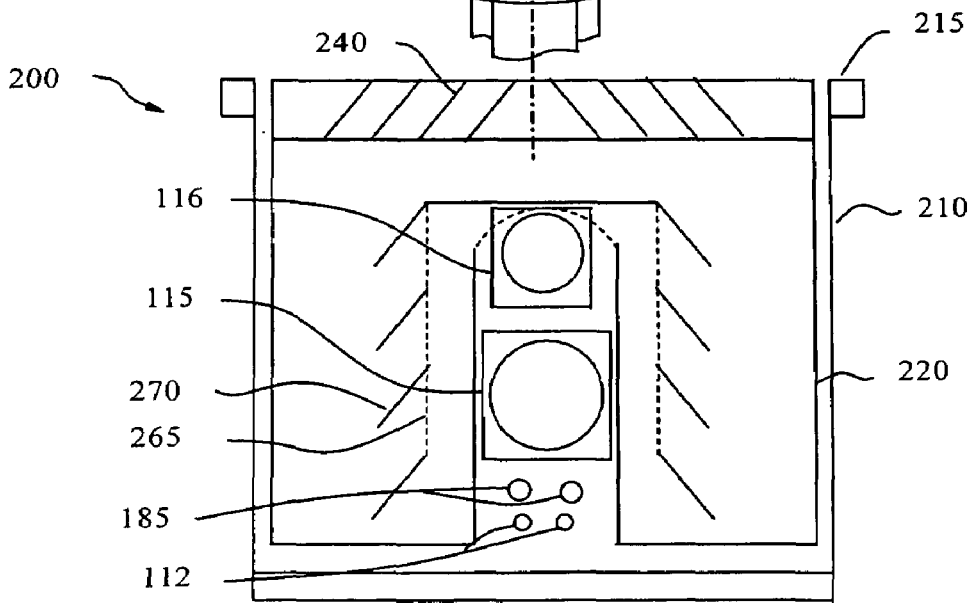

FIGS. 2*a*, 2*b*, and 2*c*, illustrate a side-view, top view, and an end view respectively, of a first embodiment of a cryopump 200 including a gas supply 110, a gas return 111, a valve assembly 118, a first stage regenerator 160, a first stage pulse tube 165, a first stage cold station 115, a second stage regenerator 170, a second stage pulse tube 175, a second stage cold station 116, a hot end assembly 195, a housing 210, a flange 215, a first stage thermal shield 220, inlet louvers 240, and a second stage cryopanel 265. Cryopanel 265 further includes fins 270.

Valve assembly 118 includes active valves 120, 125, 130, and 135, shown in FIG. 1, along with a drive motor [not shown]. Gas supply 110 and gas return 111 are supply and return lines for providing a working gas (helium) within cryocooler 100. The gas supply and return lines are connected to a through flow type compressor.

Hot end assembly 195 includes the hot ends of pulse tubes 165 and 175, buffer tank 180, fixed orifices 140, 145, 150, and 155 in bypass line 112, cooling fins 190 and cooling line 185. Hot end assembly 195 is not attached to cryopump housing 210. Cooling line 185 and bypass line 112 are part of the pulse tube assembly that is removable from cryopump housing 210.

Cryopump housing 210 is a generally cylindrical, metal enclosure that is capable of containing a cryogenic expander and cryopanel assembly while maintaining a vacuum seal with a vacuum chamber. Housing 210 may be constructed from a variety of metals such as aluminum or steel.

Flange 215 is a metal extension of housing 210, such that flange 215 may include a plurality of mounting holes that correspond to mounting devices on a vacuum system flange.

First stage thermal shield 220 is connected to first stage cold station 115 and second stage cryopanel 265 is connected to second stage cold station 116. Inlet louvers 240 are in turn connected to first stage thermal shield 220. Shield 220, louver 240, and cryopanel 265, are collectively referred to as cryopanels. The connections between the cryopanels and the cold stations are such that the temperature differences are minimized. Shield 220, louver 240, and cryopanel 265, are all removable for ease of assembly and service.

Shield 220 is a cup shaped cryopanel that is cooled by the first stage heat station of the pulse tube and in turn cools the inlet louver 240 by conduction. Shield 220 may be constructed from a metal such as copper, which has been highly polished so as to lower the radiation coefficient. It encloses the inner cryopanel 265 and shields it at least partially from room temperature radiation.

Louvers 240 are passageways or channels formed in shield 220 through which a gas can flow. A variety of flow and direction configurations may exist to distribute a gas as desired. It is cold enough to freeze group I gases, e.g. water vapor (gas groups are defined in U.S. Pat. No. 4,150,549).

Cryopanel 265 is a device onto which gas species condense. Cryopanel 265 may be constructed from a variety of metals in a variety of shapes such that the surface area, surface temperature and chemical composition optimize interaction and condensation of a gas, which is to be condensed. For example, cryopanel 265 may consist of a plurality of conical section copper panels having a charcoal coating.

Fins 270 on the second stage cryopanel 265 may exist in a variety of shapes, sizes and configurations and serve to provide a cold frontal surface for group II gases to freeze, e.g. nitrogen, and a back charcoal coated surface to adsorb group m gases, e.g. hydrogen. Fins 270 may be clustered so as to maximize both surface area and interaction with chamber gases. Fins 270 may be constructed from a sheet metal or any other material having good heat conducting characteristics along with a charcoal coating capable of absorbing various gas species.

Operation of inline pulse tube refrigerator 100 is as described for FIG. 1.

Cryopumps operate in the molecular flow pressure regime. That is the pressure is low enough so that the molecules will probably travel from one wall to another without colliding with another gas molecule. Gas flows into the cryopump by virtue of the molecular motion, which is random in direction, but the velocity is dependent on the gas temperature and species. When gas molecules from the vacuum chamber hit louver 240 or shield 220, the group I gases will freeze out while the remainder of the molecules will rebound from the surface and either leave the cryopump or hit second stage cryopanel 265. Group II gases will freeze out on cryopanel 265, while group III gases will bounce around until they hit the cold charcoal where they will be adsorbed.

Figure 3:
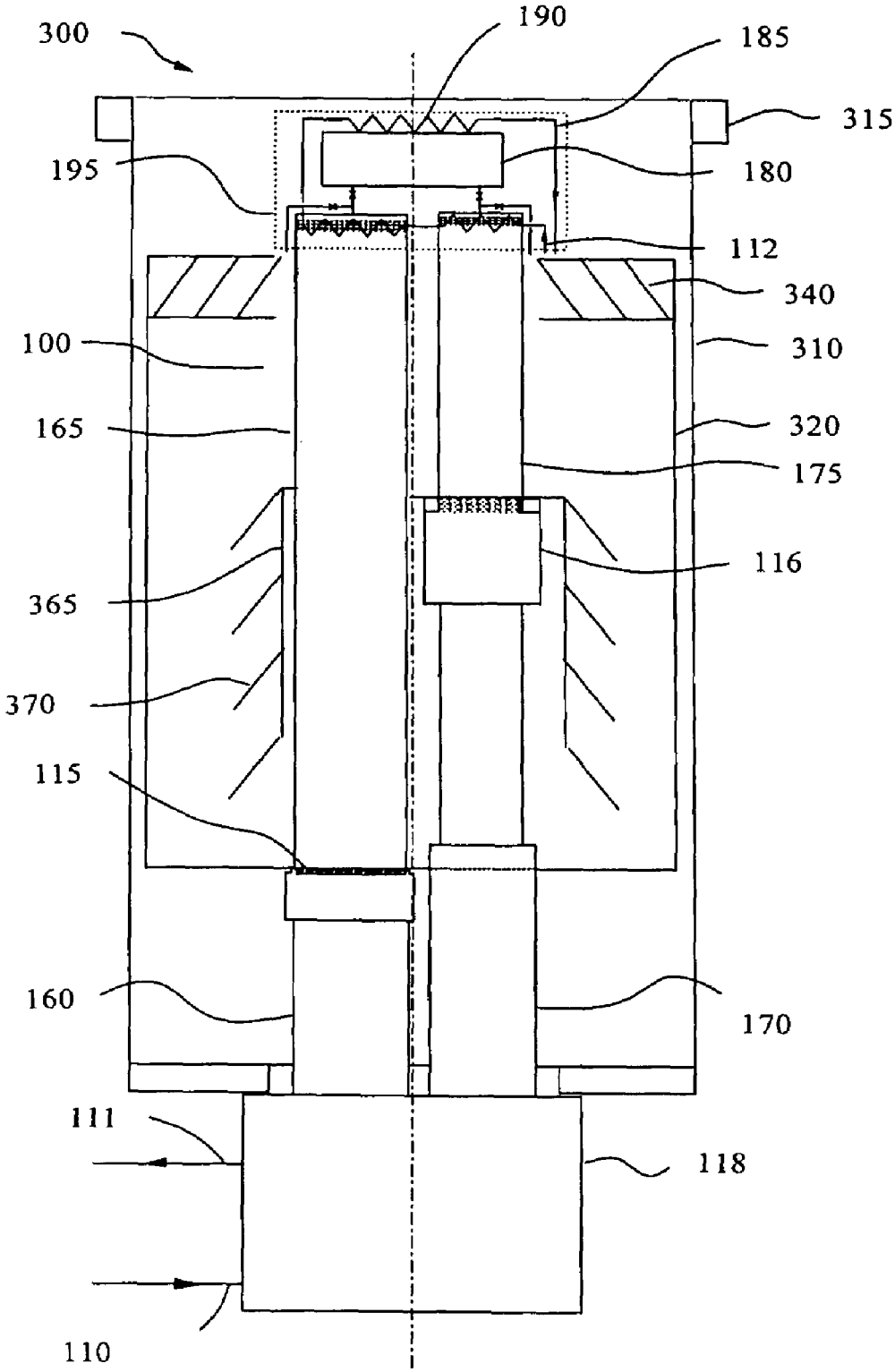
FIG. 3 illustrates another embodiment of a cryopump with the inline pulse tube refrigerator of FIG. 1.

FIG. 3 illustrates a second embodiment of the invention, where the element numbers are identified as described above.

The refrigeration systems of FIGS. 2 and 3 operate on the same principle but are configured in two different orientations. Because the pulse tube has to be operated with the hot end on top, it has to be mounted nearly vertically. A side inlet pump is shown in FIG. 2; a top inlet pump is shown in FIG. 3.

The side inlet pump, FIG. 2, is more effective because the hot end can be further from the cold panels than the top inlet design, FIG. 3. Furthermore, it is easier to get the cold inlet louver 240 closer to the flange, so the pumping speed will be higher for the side inlet pump than the top inlet pump. Pumping speed for the top inlet pump is also reduced because the hot end of the pulse tube blocks some of the flow.

Cryopump 300 includes a housing 310, a flange 315, a first stage thermal shield 335, inlet louvers 340, and a second stage cryopanel 365. Cryopanel 365 further includes fins 370.

Hot end assembly 195 is not attached to cryopump housing 310. Cooling line 185 and bypass line 112 are part of the pulse tube assembly, which is removable from cryopump housing 310.

Housing 310 is a metal enclosure that is capable of containing cryopump 300 while maintaining a vacuum seal. Housing 310 may include flange 315 with mounting holes so as to correspond to mounting devices on a process chamber. Housing 310 may be constructed from a variety of metals, such as stainless steel or aluminum.

Shield 320 is a generally cylindrical cup shaped device capable of containing a portion of cryopump 300. Shield 320 may be constructed from a metal such as copper, which has been highly polished to lower the radiation coefficient. It encloses the inner cryopanel 365 and shields it at least partially from room temperature radiation.

First stage thermal shield 320 is connected to first stage cold station 115 and second stage cryopanel 365 is connected to second stage cold station 116. Inlet louvers 340 are in turn connected to first stage thermal shield 320. Shield 320, louver 340, and cryopanel 365, are collectively referred to as cryopanels. The connections between the cryopanels and the cold stations are such that the temperature differences are minimized. Shield 335, louver 340, and cryopanel 365, are all removable for ease of assembly and service.

Cryopanel 365 may be constructed from a variety of metals in a variety of shapes such that the surface area, surface temperature, and chemical composition optimize interaction and condensation of the gas that is to be condensed.

Louvers 340 are typically at a temperature about 70 K which cause group I gases, including $H_2O$, to freeze on the louvers while group II gases, including $N_2$, and group III gases, including $H_2$, pass through. Group II gases freeze on cryopanel 365, which is typically at a temperature of about 15 K, and group III gases are adsorbed on an adsorbent, such as charcoal, that is bonded to the underside of cryopanel 365.

Operation of inline pulse tube refrigerator 100 is the same as described for FIG. 1. Operation of cryopump 300 is the same as cryopump 200 described for FIG. 2.

The invention claimed is:

1. An inline two-stage pulse tube cryopump cooling system with interphase control comprising a cryopump, a cryopump housing having a cryopump inlet in the housing, a compressor, first stage and second stage pulse tube assemblies each comprising a pulse tube, a regenerator, and a cold heat station, a first stage cryopanel attached to said first stage cold heat station, a second stage cryopanel attached to said second stage cold heat station, and an associated valve assembly, where the pulse tubes and regenerators are located inline and vertically, the hot ends of the pulse tubes are at the top, the hot ends are in the cryopump housing, and the pulse tube assemblies are removable from the cryopump housing.

2. The cryopump system of claim 1 where the cryopump housing is generally cylindrical in shape and has a cryopump inlet on either the top end or a side of the housing.

3. The cryopump system of claim 1 where the cryopanels are removable from said pulse tubes without removing the pulse tube assembly from said cryopump housing.

4. The refrigeration system of claim 1 where the valve assembly is located below the cryopump housing.

5. The cryopump system of claim 1 where heat is removed from the hot ends of the pulse tubes by an inline coolant line from the compressor input to the compressor output.

6. The cryopump system of claim 1 where a buffer volume is connected to the warm ends of the pulse tubes and is within the cryopump housing.

7. The cryopump system of claim 1 where said regenerators contain no magnetic rare-earth material.

* * * * *